US008425225B2

(12) United States Patent
Pasquinet et al.

(10) Patent No.: US 8,425,225 B2
(45) Date of Patent: Apr. 23, 2013

(54) MADE TO THE RAPID HEATING SECTIONS OF CONTINUOUS HEAT-TREATMENT LINES

(75) Inventors: Catherine Pasquinet, Bonneuil sur Marne (FR); Frédéric Marmonier, Vaucresson (FR)

(73) Assignee: Fives Stein, Maisons-Alfort (FR)

( * ) Notice: Subject to any disclaimer, the term of this patent is extended or adjusted under 35 U.S.C. 154(b) by 1098 days.

(21) Appl. No.: 12/298,850

(22) PCT Filed: Apr. 27, 2007

(86) PCT No.: PCT/FR2007/000733

§ 371 (c)(1),
(2), (4) Date: Feb. 20, 2009

(87) PCT Pub. No.: WO2007/125213

PCT Pub. Date: Nov. 8, 2007

(65) Prior Publication Data

US 2010/0062385 A1 Mar. 11, 2010

(30) Foreign Application Priority Data

May 2, 2006 (FR) ..... 06 03899

(51) Int. Cl.
*F27B 9/28* (2006.01)

(52) U.S. Cl.
USPC ..... 432/8; 432/59; 432/122; 432/231; 432/18; 432/20; 148/661; 148/657; 148/511; 148/559; 266/251

(58) Field of Classification Search ..... 432/8, 59, 432/122, 231, 18, 20; 266/251; 148/661, 148/657, 511, 559
See application file for complete search history.

(56) References Cited

U.S. PATENT DOCUMENTS

| | | | | |
|---|---|---|---|---|
| 4,239,483 | A | 12/1980 | Iida et al. | |
| 4,270,959 | A | 6/1981 | Matsumoto et al. | |
| 5,798,007 | A * | 8/1998 | Boyer et al. | 148/627 |
| 6,464,808 | B2 * | 10/2002 | Pasquinet et al. | 148/661 |
| 6,761,778 | B2 * | 7/2004 | Mignard et al. | 148/511 |
| 2002/0104598 | A1 | 8/2002 | Mignard et al. | |

FOREIGN PATENT DOCUMENTS

| | | |
|---|---|---|
| EP | 1229138 | 8/2002 |
| EP | 1507013 | 2/2005 |
| FR | 2406667 | 5/1979 |
| GB | 2068417 | 8/1981 |
| JP | 2003253343 | 9/2003 |
| WO | 0144532 | 6/2001 |

OTHER PUBLICATIONS

Shlyamnev A.P. et al.: "Continuous Heat Treatment and Pickling of Stainless Strip" Steel in the USSR, Metals Society, London GB, vol. 12, Jul. 1, 1982, pp. 330-332.

* cited by examiner

*Primary Examiner* — Avinash Savani
(74) *Attorney, Agent, or Firm* — Novak Druce Connolly Bove + Quigg LLP

(57) ABSTRACT

Method of reducing the formation of folds on metal strips (1) exposed to rapid heating in continuous heat-treatment lines, in which lines said strips are caused to pass through heating sections (2) comprising successive and separate heating means (5; 5*a*; 5*b*; 5*c*; 5*d*), wherein the average slope of the increase in temperature of the strip between the inlet and the outlet of a heating means decreases from one heating means to the following heating means.

9 Claims, 6 Drawing Sheets

MADE TO THE RAPID HEATING SECTIONS OF CONTINUOUS HEAT-TREATMENT LINES

CROSS REFERENCE TO RELATED APPLICATIONS

This application is a National Phase filing under 35 U.S.C. §371 of PCT/FR2007/000733 filed Apr. 27, 2007, which claims priority to Patent Application No. 0603899, filed in France on May 2, 2006. The entire contents of each of the above-applications are incorporated herein by reference.

The present invention relates to improvements made to the heating sections of continuous heat-treatment lines for the heat treatment of metal strip.

It proposes in particular to reduce the risk of thermally induced wrinkles that form on metal strip that undergoes rapid heating in continuous heat-treatment lines, in which said strip pass through rapid heating zones equipped with discontinuous heating means.

"Rapid heating" denotes heating that ensures a temperature rise of the strip with a gradient of at least 100° C./second at the start of heating.

In order to situate properly the technical field to which the present invention applies, reference will first be made to FIG. 1 of the appended drawings, which schematically represents an example of a section for heating a metal strip in a heat-treatment line.

In this FIG. 1 it is seen that the strip 1 passes through the rapid heating section 2 by passing over a feed roll 3 and a delivery roll 4. While passing through the section 2, the strip 1 is successively exposed to four distinct heating means 5, respectively 5*a*, 5*b*, 5*c*, 5*d*, positioned on both sides of the strip and separated along the direction in which the strip runs by a distance Δ, for example Δab between the heating means 5*a* and 5*b*.

The heating means 5 rapidly increase the temperature of the strip, with a gradient of at least 100° C./second, by exposing it to a large heat flux. The method employed by these rapid heating means is, for example, longitudinal-flux or transverse-flux induction heating.

The heating may be carried out in air or in an atmosphere that is non-oxidizing for the strip.

As represented in FIG. 2, the strip is no longer exposed to a heat-supply flux between two distinct heating means 5. The strip therefore undergoes a discontinuity in heating. Depending on the quality of the insulation between these two heating means, the temperature of the strip reached on leaving one heating means is at best maintained through to its entry into the next heating means. The temperature of the strip may also decrease due to heat losses.

This discontinuity in heating leads to transverse tensile stresses and transverse compressive stresses in the strip, perpendicular to the axis of the strip. The phenomenon causing these stresses is described below.

The rapid heating causes an expansion in the strip material in directions parallel and perpendicular to the direction in which the strip runs. The expansion in the direction in which the strip runs is compensated for by the device for controlling the tension in the strip with which the heating section, or the line in which this heating section is integrated, is equipped.

The expansion taking place in the direction perpendicular to the running of the strip generates forces within the material. These are tensile forces when they are directed from the axis toward the edges of the strip and compressive forces when they are directed toward the axis of the strip.

Over the entire length of the heating means 5, if the intensity of the flux for heating the strip is constant, there is no significant difference between the compressive forces existing in one section of the strip and that which precedes it in the direction in which this strip runs.

When the strip enters the first, or the next, heating means 5 it undergoes a very rapid positive variation in the intensity of the heat flux received, corresponding to the resumption of heating. This change in the rate of variation of the function (dTemperature/dtime) leads to tensile forces in the strip.

Similarly, when the strip leaves a heating means 5, it undergoes a very rapid negative variation in the intensity of the heat flux received, corresponding to the cessation of heating. This new change in the rate of variation of the function (dTemperature/dtime), or (dTemperature/dLength), leads to compressive forces in the strip.

FIG. 3 of the appended drawings represents the variation in these stresses during the heating of the strip. The curve T1 represents the temperature increase of the strip between Ta and Tb when passing into a heating means 5. The curve C1 corresponds to the level of transverse stress in the strip. The horizontal line H passing through the 0 point of stresses plotted on the y-axis corresponds to a zero transverse stress. A point on the curve C1 lying above the line H corresponds to a tensile stress, marked positive, while a point on the curve C1 lying below the line H corresponds to a compressive stress, marked negative.

It can be seen clearly that for each change in the rate of variation of the function (dTemperature/dtime), or (dTemperature/dLength), corresponding to a modification in the heating gradient on T1, a peak appears corresponding to the absolute value of the stress on the curve C1. The first stress peak Ca corresponds to the point Ta on the curve T1 where the temperature growth begins. This is a tensile stress. The second stress peak Cb corresponds to the point Tb on the curve T1 where the temperature growth ceases. This is a compressive stress.

The magnitude of these stress peaks depends on the format of the strip and on the variation in the gradient of the temperature curve between Ta and Tb, i.e. on the variation in the heating rate at the point of the curve that corresponds to the moment when the strip enters or leaves the heating zone corresponding to a heating means 5.

The stresses perpendicular to the axis of the strip which produce compressive forces may, if they reach too high a level, generate surface quality defects in the strip such as ripples, blisters, wrinkles or fractures. These surface defects may take various forms, they may be continuous over the length of the strip or discontinuous, they may be parallel to the axis of the strip or snake across its breadth. They may be singular or develop in the form of several wrinkles that are parallel, continuous, discontinuous, linear or according to a regular or irregular curve. To simplify explanation, the term "wrinkles" is used in the following to denote all defects in the strip caused by excessive transverse compressive stresses.

These defects appear when the level of transverse compressive stress in the strip is greater than a stress threshold which constitutes a limit called the "critical stress" that depends mainly:

- on the composition and mechanical properties of the strip, on its metallurgical state;
- on the temperature of the strip; and
- on the format of the strip, its width and its thickness.

The critical compressive stress level, beyond which a surface defect is generated, is proportional to the mechanical strength of the strip material. As the mechanical strength of the strip decreases when the temperature rises, and does so increasingly quickly, as the temperature rises, the level of the critical compressive stress also falls with temperature, increasing accordingly the risk of forming wrinkles as the temperature of the strip increases.

According to the prior art, the rapid heating sections of continuous heat-treatment lines for metal strips are designed without considering the risk of wrinkle formation. Due to this, for a given heating section the operators responsible for the operation of the line must, in the absence of a known method, have to adapt the setting of the furnace by successive trial and error until an operational point limiting these defects is found. These settings lead to an operation of the furnace that does not fully exploit the available power, which leads to a loss of production, for example when the operators have to reduce the running speed of the strip.

The invention has the aim, above all, of providing a method that limits wrinkle formation in the strip in the course of being rapidly heated while preserving the nominal speed of the strip in passing through the rapid heating section, i.e. without loss of production.

According to the invention, the method for reducing wrinkle formation on a metal strip undergoing rapid heating in continuous heat-treatment lines, in which said strip passes through heating sections comprising successive and distinct heating means, is characterized in that the average gradient for temperature increase of the strip between entering and leaving a heating means falls from one heating means to the next heating means.

The invention allows reduction in wrinkle formation on the strip in a strand located between two drive rolls 3, 4, according to FIGS. 1 and 2. The wrinkles that the invention allows to be reduced are generated by the thermal path of the strip, independently of any contact of the strip with a deflector roll.

Advantageously, the ratio of the temperature difference for the strip between its leaving and entering a heating means to the distance between the exit and the entrance to this heating means falls from one heating means to the next heating means.

The instantaneous gradient for temperature increase of the strip between its entering and leaving a heating means, as a function of the distance covered, is preferably higher on entry to the heating means than toward the exit from this heating means.

The difference in heating intensity between two successive heating means may be progressively reduced so as to be small at high temperature so that the variation in the heating rate at all points of the strip decreases as the temperature of the strip increases.

The heating intensity between each heating means is progressively modified and the heating intensity between two successive heating means is reduced as the temperature of the strip increases.

Advantageously, a greater heat flux is injected into the strip when this is at low temperature, then the injected heat flux is progressively reduced when the temperature of the strip increases.

The heating may be provided to raise the temperature of the strip in each heating means by less and less from the first heating means where the temperature rise is the greatest.

Preferably, the change in the flux exchanged between the strip and the heating means is progressive, i.e. the variation in the heating gradient is progressive.

The gradient of the temperature rise of the strip in the first heating section is advantageously greater than 100° C./second.

The magnitude of the reduction in the temperature rise gradient when passing from one heating section to the next is determined depending on the format of the strip and the quality of the steel. Advantageously, the temperature rise gradient for the strip falls by at least 15° C./second when passing from one heating section to the next.

The method of the invention limits the corresponding stress peak in the material and reduction of the compressive forces perpendicular to the direction in which the strip runs, which appear at this location between two consecutive sections of the strip, causing wrinkles in the latter.

The invention consists, apart from the provisions disclosed above, of a certain number of other provisions which will be dealt with more explicitly below with regard to embodiments described with reference to the appended drawings, but which are in no way limiting. In these drawings FIG. 1 is a schematic vertical section through a rapid heating section of a heat-treatment line for metal strip;

FIG. 2 repeats the diagram of FIG. 1 with the corresponding heat flux injected by each heating means according to the prior art;

Figure 1:
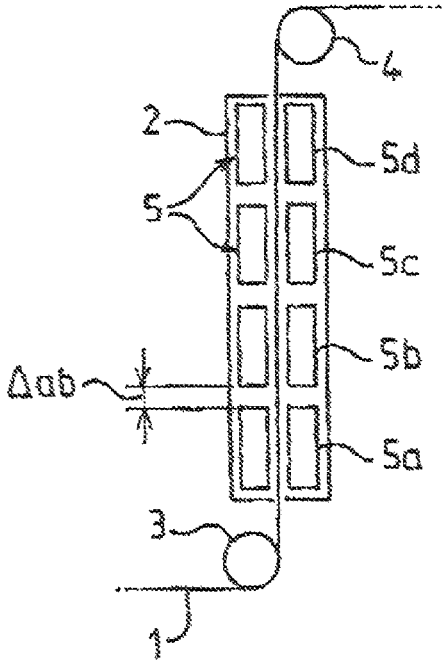
Figure 2:
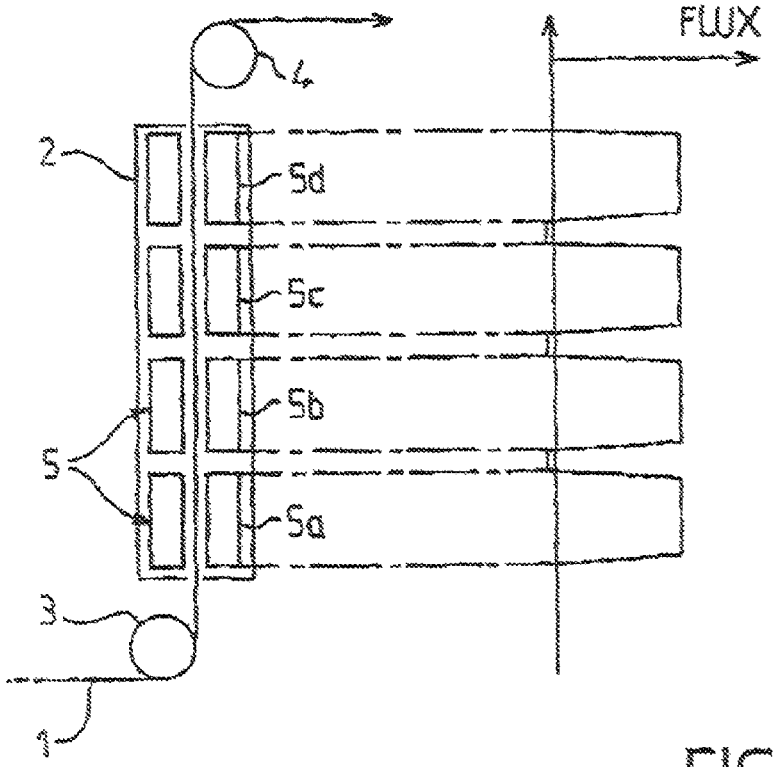
Figure 3:
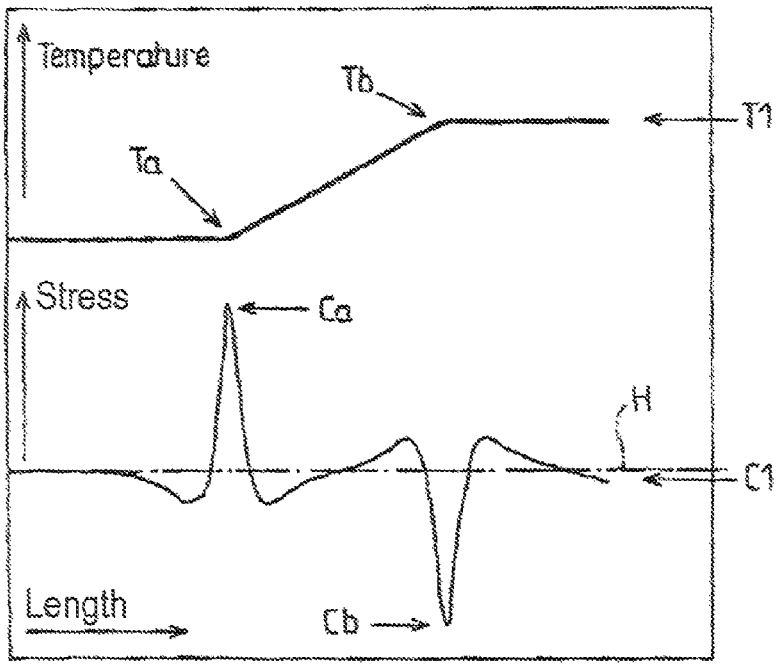
FIG. 3 is a graph illustrating the appearance of stresses caused in a metal strip by a temperature variation.
Figure 5:
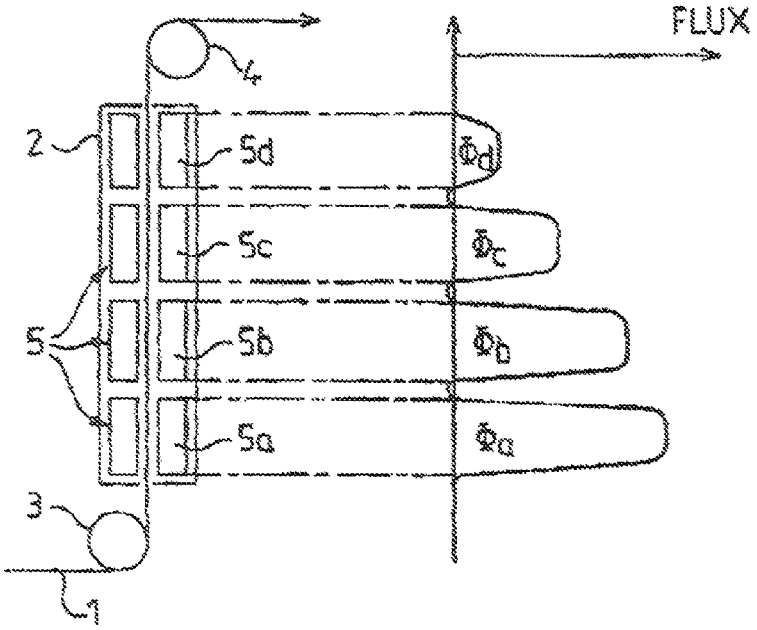
Figure 6:
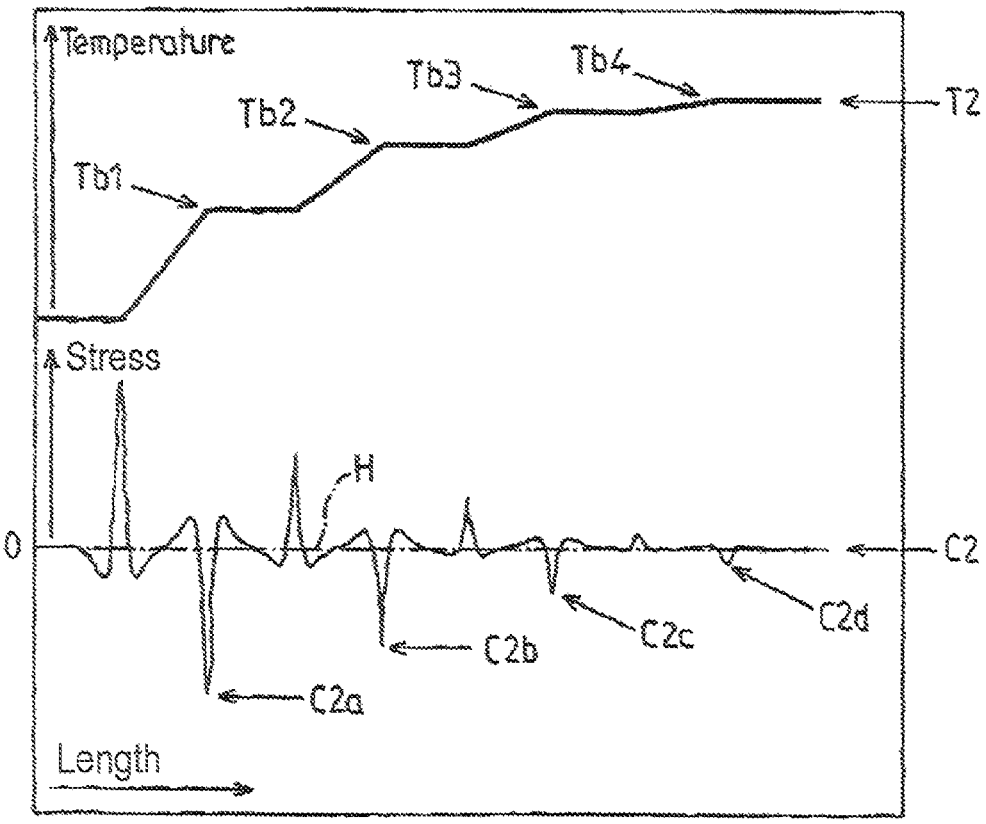
Figure 7:
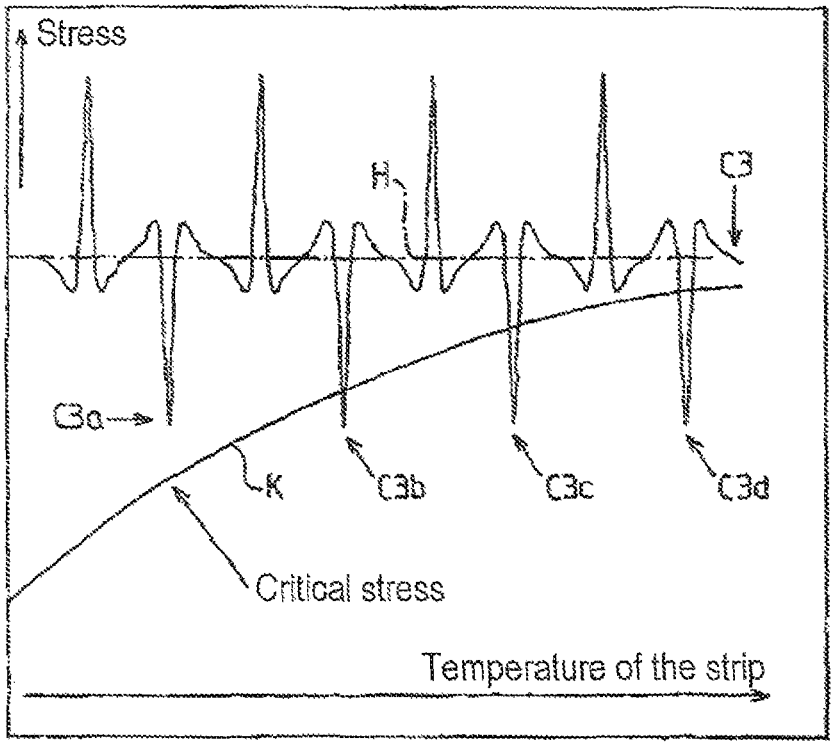
Figure 8:
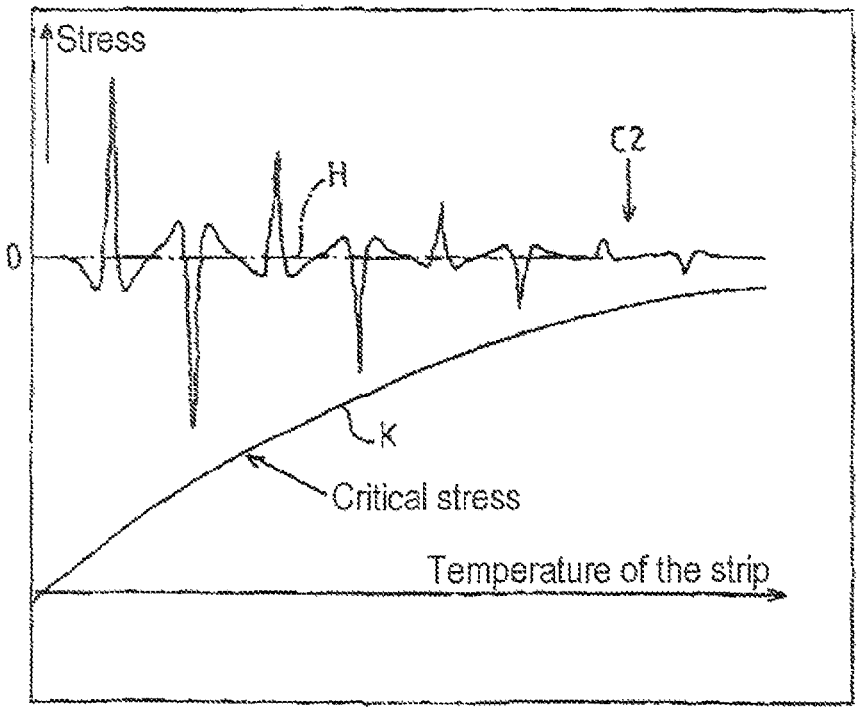
Figure 9:
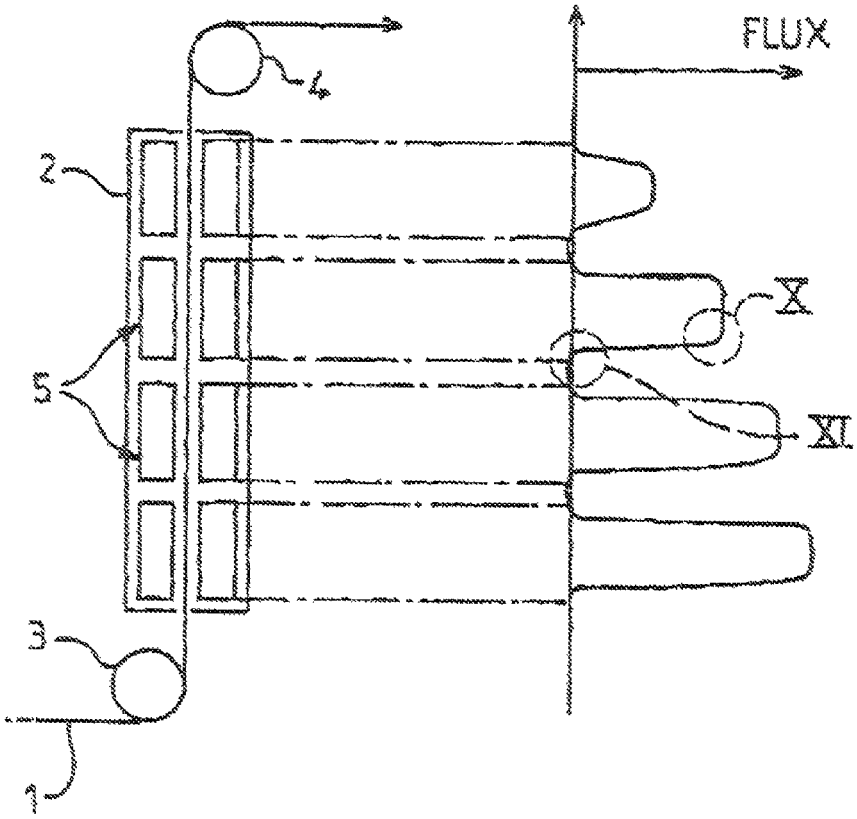
Figure 10:
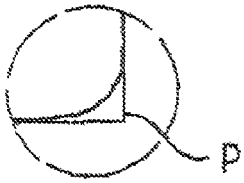
Figure 11:
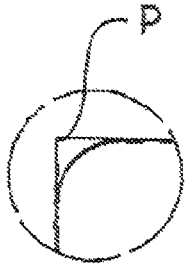

FIG. 5 repeats the diagram of FIG. 2 with the corresponding heat flux injected by each heating means according to the invention;

FIG. 6 is a graph illustrating the stresses in a metal strip heated according to the method of the invention;

FIG. 7 is a graph illustrating the stresses in a metal strip heated according to a conventional method of the prior art;

FIG. 8 is a graph illustrating the stresses in a metal strip heated according to the method of the invention;

FIG. 9 repeats the diagram of FIG. 5 with the heat flux injected by each heating means according to the invention;

FIG. 10 shows the enlarged detail X from FIG. 9;

FIG. 11 shows the enlarged detail XI from FIG. 9; and

Figure 12:
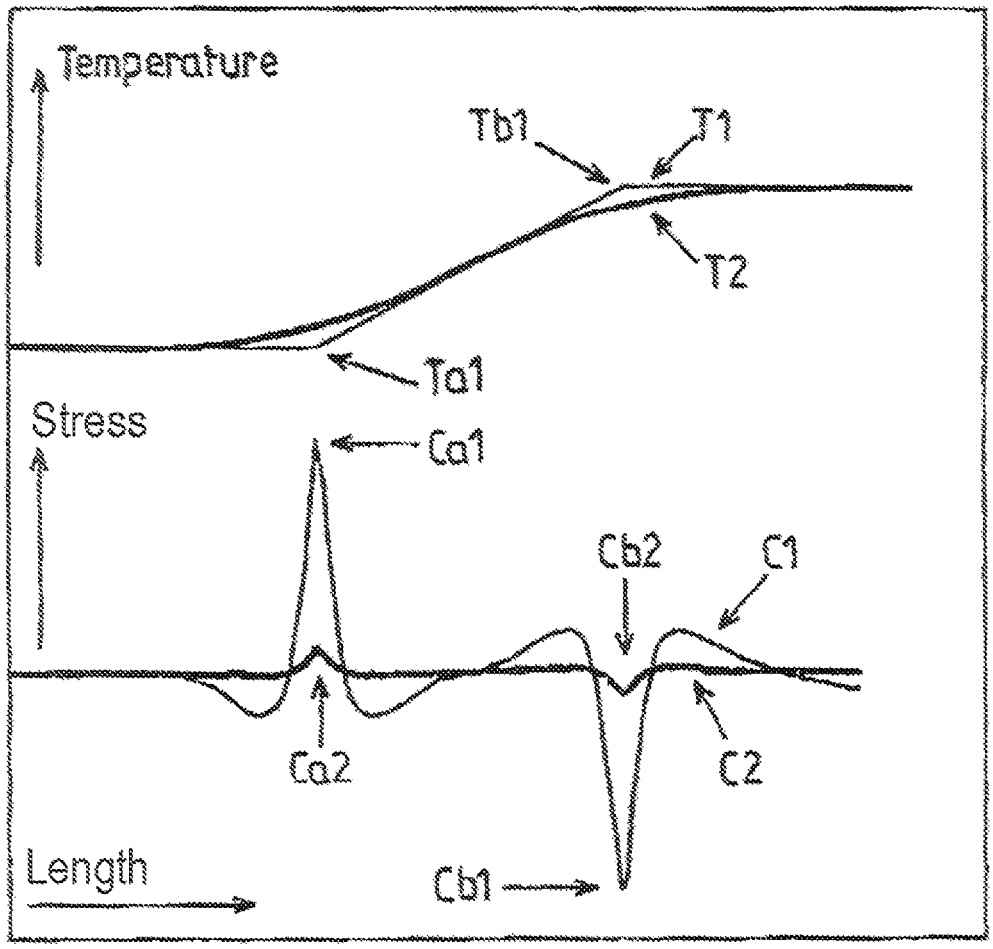

FIG. 12 is a graph illustrating the stress variations and the temperature variations in a metal strip heated according to the method of the invention.

Figure 4:
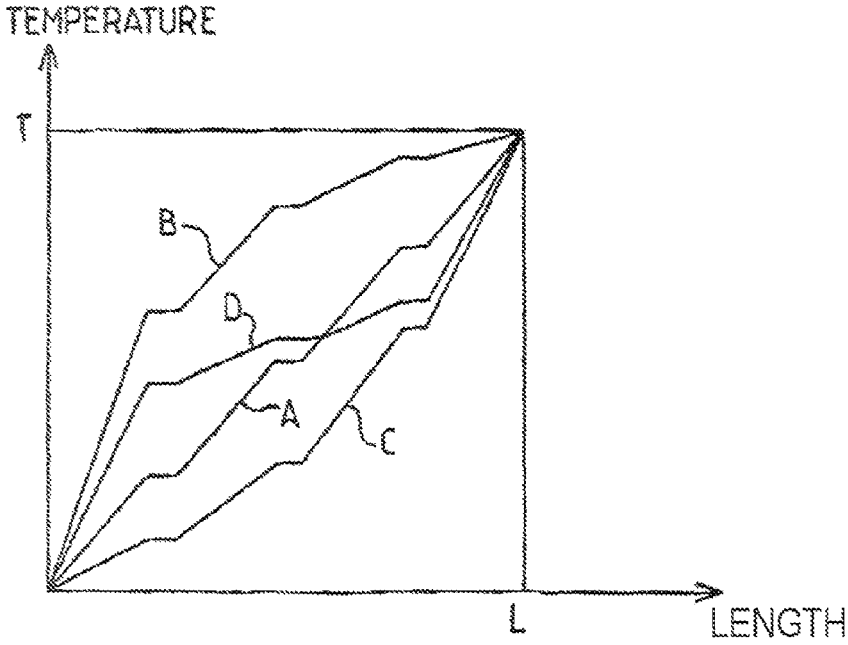
FIG. 4 is a graph illustrating several heating modes including one according to the invention.

Reference is now made to FIG. 4, which is a graph with the length of the heating section equipped with four inductors traveled by a point on the metal strip plotted on the x-axis, and the temperature of the strip at this point plotted on the y-axis. It can be seen that to attain the same thermal objective, corresponding to a temperature T at the end of the heating section, corresponding to the length L, it is possible to follow various thermal paths:

- path A corresponds to the same gradient of the temperature rise of the strip in each heating means;
- path B corresponds to a gradient of the temperature rise of the strip that progressively decreases in each heating means from the first heating means where it is highest;
- path C corresponds to a gradient of the temperature rise of the strip that progressively increases in each heating means from the first heating means where it is lowest; and
- path D corresponds to a combination of the paths B and C with a gradient of the temperature rise of the strip that is higher in the first and last heating means and lower for the two central heating means.

These four thermal paths are provided by way of example, in the knowledge that numerous other variations are possible.

According to the invention, the strip is heated in the heating section by following the thermal path B of temperature rise. As represented in FIG. 5, this thermal path is obtained by injecting a large heat flux $\phi a$ into the strip at the start of heating, when this strip is at lower temperature, then by progressively limiting the injected flux $\phi b$, $\phi c$, $\phi d$ as the temperature of the strip increases.

The heat fluxes are advantageously chosen such that:

the gradient of temperature rise of the strip in the first heating section, i.e. in the first heating means 5*a*, is greater than 100° C./second; and the gradient of temperature rise of the strip is reduced by at least 15° C./second when passing from one heating section to the next, i.e. from one heating means to the next.

As shown in FIG. 6, the thermal path according to the invention limits the variation in the gradient of the curve of the temperature on leaving each heating element as the strip rises in temperature. The compressive stresses perpendicular to the axis of the strip, which are likely to generate wrinkles, are then progressively lower on leaving each successive rapid heating zones: C2*a*>C2*b*>C2*c*>C2*d*.

The heating ensured by the successive heating means 5*a*, 5*b*, 5*c*, 5*d* is such that the mean curve representing the rise in temperature of the strip as a function of the length of the heating section has a hollow turned toward the x-axis on which the length is plotted. "Mean curve" designates a curve passing through the middles of straight horizontal segments of the real temperature rise curve in FIG. 6. The mean gradient of the increase in temperature of the strip between entering and leaving a heating means falls from one heating means to the next heating means.

As shown in FIG. 7, the level (in absolute value) of critical stress for wrinkle formation decreases when the temperature increases according to a curve K, the stress being plotted on the y-axis and the temperature plotted on the x-axis. A heating section produced according to the prior art, i.e. without applying the heating method according to the invention, would lead, for example, to the stress curve C3, corresponding to the thermal path A of FIG. 4. It may be observed that the transverse compressive stresses on this curve are greater at the points C3*b*, C3*c* and C3*d* than the critical threshold values. The strip will therefore be covered with surface defects and unsaleable.

It will be understood that the thermal paths C and D are not suitable because they lead to large stresses greater than the critical stress in the zones where the strip is the hottest.

As previously shown in FIG. 5, the heating method according to the invention consists in injecting a higher heat flux into the strip when it is at low temperature, then in progressively reducing this flux when the strip rises in temperature.

FIG. 8 corresponds to FIG. 7, but with heating carried out according to the method of the invention. It can be observed that the transverse compressive stresses on the stress curve C2 of this FIG. 8 are always less (in absolute value) than the critical threshold values according to the curve K. The strip will be free from wrinkles and therefore saleable.

To further limit the risk of wrinkle formation, the invention is also characterized by a method which consists in progressively modifying the heating intensity in each heating means 5 so that the change in the flux exchanged with the strip is progressive, i.e. the change in the rate of variation of the function (dTemperature/dtime), corresponding to a modification in the heating gradient, is progressive.

This method allows limitation of the corresponding stress peak in the material and reduction or elimination of the compressive forces perpendicular to the direction the strip runs, which appear at this location between two consecutive sections of the strip, causing wrinkles in the latter.

The method according to the invention is illustrated in greater detail in FIG. 9. As represented in this FIG. 9, the variation in flux between the strip and the heating means 5, according to the invention, is progressive between entering through to leaving each heating means 5, whereas rapid heating according to the prior art would lead to the flux curve P, represented with thin lines in FIGS. 10 and 11, with abrupt changes in the flux variation. This progressive variation of the flux according to the invention is depicted in FIG. 9 by a rounded flux curve during changes in gradient between temperature rise, upper plateau, then descent and lower level, whereas these changes are at sharp breaks on the curve P according to the prior art.

This progressive change in flux leads to a progressive change in the temperature of the strip for each heating element, i.e. to a progressive change in the rate of variation of the function (dTemperature/dtime) in relation to the prior art, as shown in FIG. 12. Hence, the points of abrupt gradient change Ta1 and Tb1 of the temperature curve T1 according to the prior art, corresponding to heating with a rapid change in the heating intensity, have been eliminated in the curve T2 corresponding to heating according to the invention with a progressive change in heating intensity.

It can be seen clearly in FIG. 12 that the change in the temperature of the strip, represented by the curve T2 corresponding to heating with a progressive change in flux transmitted to the strip, leads to a stress curve C2 for which the size of the tensile stress peak Ca2 and the compressive stress peak Cb2 has been greatly reduced in relation to that of the corresponding peaks Ca1, Cb1 of the stress curve C1 according to the prior art: Ca2<<Ca1 and Cb2<<Cb1.

As the reduced level of transverse compressive stress Cb2 obtained is hence less than the critical threshold, the strip will be free from wrinkles and hence saleable.

The invention claimed is:

1. A method for reducing thermally induced wrinkle formation on a metal strip undergoing rapid heating in continuous heat-treatment lines, in which said strip passes through heating sections comprising successive and distinct heating means having an entry and an exit, wherein an average gradient for temperature increase of the strip between entering and leaving a heating means falls from one heating means to the next heating means, and wherein a temperature rise gradient for the strip falls by at least 15° C./second when passing from one heating section to the next.

2. The method as claimed in claim 1, wherein a ratio of a temperature difference for the strip between its leaving and entering one of the heating means to the distance between the exit and the entrance to this heating means falls from one heating means to the next heating means.

3. The method as claimed in claim 1, wherein an instantaneous gradient for temperature increase of the strip between its entering and leaving one of the heating means, as a function of the distance covered, is higher on entry to the heating means than toward the exit from this heating means.

4. The method as claimed in claim 1, wherein a difference in heating intensity between two successive heating means is progressively reduced to be low at high temperature so that the variation in the heating rate at all points of the strip decreases as the temperature of the strip increases.

5. The method as claimed in claim 1, wherein an heating intensity between each heating means is progressively modified and in that the heating intensity between two successive heating means is reduced as the temperature of the strip increases.

6. The method as claimed in claim 1, wherein a greater heat flux ($\phi a$) is injected into the strip when it is at low temperature, then the injected heat flux ($\phi b$, $\phi c$, $\phi d$) is progressively reduced when the temperature of the strip increases.

7. The method as claimed in claim 1, wherein the heating is provided to raise the temperature of the strip in each heating means by less and less from a first of the heating means where the temperature rise is the greatest.

8. The method as claimed in claim 1, wherein a change in the flux exchanged between the strip and the heating means is progressive, i.e. a variation in the heating gradient is progressive.

9. The method as claimed in claim 1, wherein the gradient of the temperature increase of the strip in the first heating section is greater than 100° C./second.

* * * * *

UNITED STATES PATENT AND TRADEMARK OFFICE

CERTIFICATE OF CORRECTION

PATENT NO. : 8,425,225 B2
APPLICATION NO. : 12/298850
DATED : April 23, 2013
INVENTOR(S) : Catherine Pasquinet and Frederic Marmonier It is certified that error appears in the above-identified patent and that said Letters Patent is hereby corrected as shown below:

On the Title page, item (54) and in the Specification, Column 1, lines 1-2, title, before the text "MADE TO THE RAPID HEATING SECTIONS OF CONTINUOUS HEAT-TREATMENT LINES", insert the text --IMPROVEMENT--

Signed and Sealed this
Thirteenth Day of May, 2014

Michelle K. Lee

Michelle K. Lee
*Deputy Director of the United States Patent and Trademark Office*